US006192978B1

(12) United States Patent
Guzowski et al.

(10) Patent No.: US 6,192,978 B1
(45) Date of Patent: Feb. 27, 2001

(54) MICRO-MULTIPORT (MMP) TUBING WITH IMPROVED METALLURGICAL STRENGTH AND METHOD FOR MAKING SAID TUBING

(75) Inventors: Matthew M. Guzowski, Aurora, OH (US); Frank F. Kraft, Adrian; Henry R. McCarbery, Palmyra, both of MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

(21) Appl. No.: 09/427,864

(22) Filed: Oct. 27, 1999

(51) Int. Cl.[7] ..... F28F 1/02; B21D 53/06

(52) U.S. Cl. ..... 165/177; 72/256; 72/370.17; 72/370.26; 29/890.049

(58) Field of Search ..... 165/177; 72/256, 72/370.17, 370.26; 29/890.049, 890.053

(56) References Cited

U.S. PATENT DOCUMENTS 5,058,266 * 10/1991 Knoll ..... 29/890.049
5,251,692 * 10/1993 Haussmann ..... 165/152
5,988,967 * 11/1999 Jones ..... 411/489

FOREIGN PATENT DOCUMENTS 60-205192 * 10/1985 (JP) ..... 165/177

* cited by examiner

*Primary Examiner*—Allen Flanigan
(74) *Attorney, Agent, or Firm*—Harness, Dickey & Pierce, P.L.C.

(57) ABSTRACT

This invention is a process for making micro-multiport tubing for use in automobile air conditioner heat exchangers. The tubing is a flat body with a row of side-by-side passageways, which are separated by upright webs. Processing of this tubing involves extrusion, a straightening and cutting operation, assembly and furnace brazing of the condenser. This invention improves the grain size of the metal in the tubing and also improves the metallurgical strength of the tubing. Ports are formed in the tubing during extrusion. These ports are separated by webs and the webs are extruded so that they have a reduced thickness at their centers. In response to successive cold working of the body, the webs are changed in shape to a more uniform thickness state. Stated other wise, in this invention, the webs are initially of hour glass shape such that when there is five percent change in material thickness, the strain is concentrated at the center of the web and results in at least fifteen percent cold work. With fifteen percent cold work or more, the amount of grain growth is controlled and the improvement in the metallurgical strength is achieved.

3 Claims, 1 Drawing Sheet

MICRO-MULTIPORT (MMP) TUBING WITH IMPROVED METALLURGICAL STRENGTH AND METHOD FOR MAKING SAID TUBING

BACKGROUND AND SUMMARY OF INVENTION

Contemporary automotive air conditioning systems typically use parallel flow condensers that are fabricated with extruded tubing. This tubing, which is referred to as micro-multiport (MMP) tubing, is made from 1XXX or 3XXX Al alloys. The tubing is a flat body with a row of side-by-side passageways, which are separated by upright webs. Processing of this tubing involves extrusion, a straightening and cutting operation, assembly and furnace brazing of the condenser. Brazing is generally done at 600°–605° C. (about 94% of the melting temperature of pure Al). The tube straightening operation imposes a small amount of cold work, in the critical range, which causes extremely coarse grains to grow during the brazing process.

Material handling involves winding the tube on coils and transferring these coils to a straightening and cutting operation. It is during this operation that the final width, thickness and length dimensions of the cut pieces are achieved. The cut pieces are then assembled into a condenser core with fin stock and headers that are clad with a brazing alloy. This assembly is brazed at 600 to 605° C.

The production of automotive condensers from aluminum MMP tubing involves an interaction of process conditions that can result in undesirable material properties. The combination of a small amount of cold work and the high brazing temperature that must be imposed on the tube cause extremely large grains to form, and this has a significant effect on mechanical properties.

Small amounts of cold work are imposed on the tube during straightening/sizing and material handling. This small amount of deformation can lead to a phenomenon in which very large grains in the aluminum are formed during the brazing process. If a critical amount of cold work is imposed on the tube prior to brazing, then extremely large grains will form after recrystallization. The critical amount of cold work is defined as the amount of strain just necessary to initiate recrystallization. Since few nuclei are formed in the metal, the growth of relatively few recrystallized grains is allowed to proceed with minimum resistance. Conversely, as the amount of cold work increases, more nuclei are produced and the recrystallized grain size decreases.

This invention improves the grain size and the metallurgical strength of the tube by cold working the webs in the tubes and controlling the grain size. The webs in the tube body between each pair of said passages are substantially hour glass shape, namely, an upright wall with a reduced thickness section substantially midway between the top and bottom ends of the wall. In response to successive cold working of the body, the webs are changed in shape from the hour glass shape to a more uniform thickness shape. Stated otherwise, in this invention, the sides of the webs are tapered at an angle such that when there is a 5% change in material thickness, the strain is concentrated at the center of the web and results in at least 15% cold work. At 15% cold work or more the amount of grain growth will be controlled.

Accordingly, this invention provides an improved process for enhancing the metallurgical strength of a multiport tube for use in a condenser or an evaporator. The invention provides a multiport tube which includes webs between the ports that are configured such that when there is a five percent change in material thickness, the strain from cold working of the tube is concentrated at the center of the webs to improve the strength of the tubing and maintain the desirable small grain growth in the metal tube.

Further objects, features and advantages will become apparent from a consideration of the following description and the appended claims when taken in connection with the accompanying drawings.

DETAILED DESCRIPTION OF THE PREFERRED EMBODIMENT OF THE INVENTION

Figure 1:
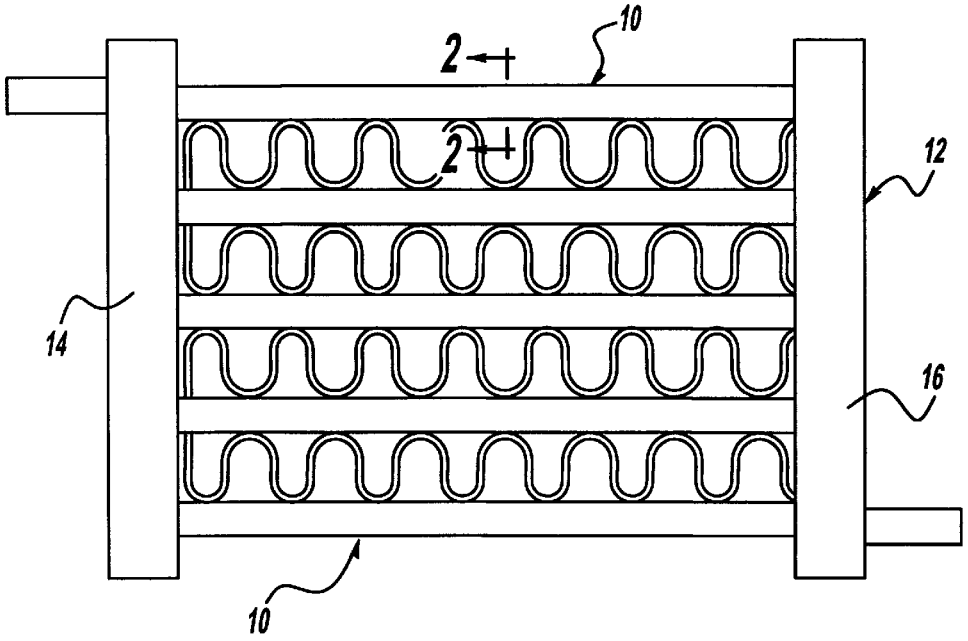
FIG. 1 shows a heat exchanger utilizing the multiport tubing of this invention.
Figure 2:
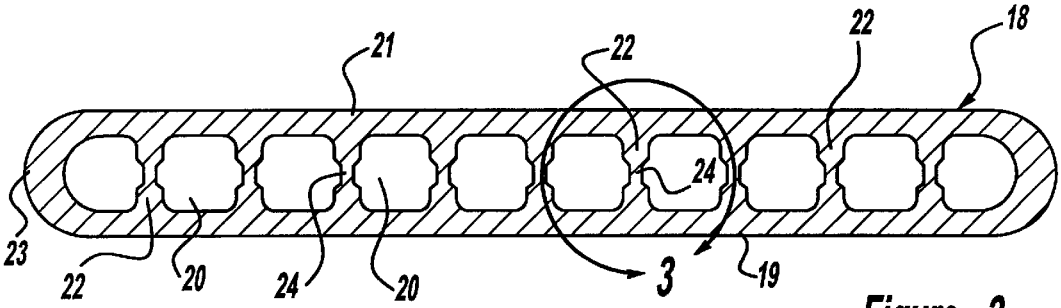
FIG. 2 is an enlarged cross-sectional view of the tubing of this invention as seen from the line 2—2 in FIG. 1.

With reference to the drawing, the tubing of this invention, indicated at 10 in FIG. 1, is shown in a heat exchanger 12 with frame members 14 and 16. The tubing 10 consists of a metal body 18, which is aluminum or an aluminum alloy. The body 18 is made by extrusion and the shape of the body 18 is as shown in FIG. 2. The body is generally rectangular in shape having opposite faces 19 and 21 and outwardly facing rounded edges 23. A number of ports or passages 20 are arranged side-by-side between the edges 23. All of the ports 20 are of the same size and shape except for the end ports which vary only on one side.

Figure 3:
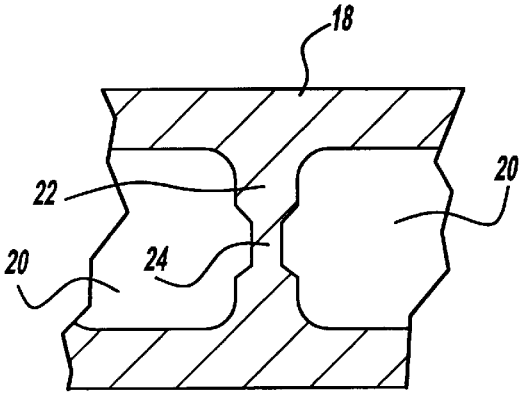
FIG. 3 is a fragmentary cross-sectional view of a portion of the tubing indicated at 3 in FIG. 2, and showing the geometry of a web in the tubing as it has been formed by extrusion.

As shown in FIG. 3, the ports 20 are defined by webs 22, which extend in upright positions with a reduced thickness section 24 in substantially the center of the web 22. In the body 18 illustrated in FIG. 2, there are ten ports in side-by-side relation and each one is defined by at least one web 24. The tube 18 is of a flattened configuration having a width that is at least three times as long as the height of the body 18. In actual practice, the body 18 is ¾ to one inch wide, 0.080 inches high and part of a long extrusion, which is coiled for subsequent cutting into strips and straightening.

Figure 4:
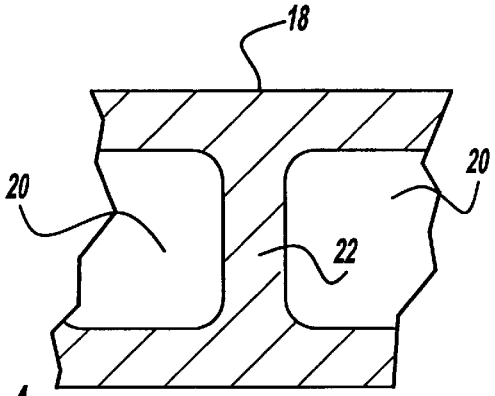
FIG. 4 is a fragmentary cross-sectional view of the tubing like FIG. 3 after it has been cold worked so as to alter the shape of the web shown in FIG. 3.

It is during the coiling, straightening and cutting operations that the final width, thickness and length dimensions of the cut pieces are achieved. These pieces are then assembled into the frame 12 and subjected to brazing with a brazing alloy at temperatures between 600° and 605° C. In this invention, the body 18 is subjected to additional cold working, such as rolling the body that will compress the body 18, so as to reform the webs 22 to the shape shown in FIG. 4, in which the web 22 is of a uniform width. Also, this additional cold working of the body 18 functions to control the grain size of the metal. In other words, the smaller grains are retained or nucleation takes place and additional smaller grains are achieved.

From the above description, it is seen that this invention enhances the metallurgical strength of the tubing 10 so that the life of the heat exchanger 12 is extended and the tubing 10 will function for a longer time without maintenance.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A multi-port tube for use in a condenser or evaporator for a heat exchanger, said tube comprising an extruded metal body made at least partly from aluminum, said body having an extensive width and a thickness less than one third of its width, means providing side-by-side similar passages in said body extending in a row from side-to-side of said body, webs in said body between each pair of said passages, each web being substantially hour glass shape, namely, an upright wall with a reduced thickness section substantially midway between the top and bottom ends of the wall, whereby in response to successive cold working of said body, said webs are changed in shape from said hour glass shape to a more uniform thickness between said top and bottom.

2. A process for improving the metallurgical strength of a multiport tube for use in a condenser or an evaporator, coiling said tube, said tube comprising an extruded metal body made at least partly from aluminum, said body having an extensive width and a thickness less than one third of this width, means providing a number of similar passages in said body extending in a row from side-to-side of said body, webs in said body between each pair of said passages, each web being substantially hour glass shape, namely, an upright wall with a reduced thickness section substantially midway between the top and bottom ends of the wall, the step of cold working said length of tube to change the shape of the webs from said hour glass shape to a more uniform thickness.

3. The process according to claim 2 wherein said cold working of said tube is accomplished by rolling the tube to reduce the thickness of the tube.

* * * * *